US010448457B2

(12) United States Patent
Johnson et al.

(10) Patent No.: US 10,448,457 B2
(45) Date of Patent: Oct. 15, 2019

(54) REDUCING PREHEAT TIME IN AN OVEN

(71) Applicant: General Electric Company, Schenectady, NY (US)

(72) Inventors: Eric Scott Johnson, Louisville, KY (US); James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 980 days.

(21) Appl. No.: 14/923,755

(22) Filed: Oct. 27, 2015

(65) Prior Publication Data

US 2017/0118798 A1 Apr. 27, 2017

(51) Int. Cl.

*H05B 1/02* (2006.01)
*F24C 7/08* (2006.01)
*F24C 15/32* (2006.01)

(52) U.S. Cl.

CPC ..... *H05B 1/0263* (2013.01); *F24C 7/08* (2013.01); *F24C 7/087* (2013.01); *F24C 15/325* (2013.01)

(58) Field of Classification Search

CPC ..... H05B 1/02; H05B 1/0263; H05B 1/0266; H05B 1/0261; H05B 3/0076; H05B 6/12; F24C 7/08; F24C 7/087; F24C 7/085; F24C 15/322; F24C 15/325

USPC ..... 219/486

See application file for complete search history.

(56) References Cited

U.S. PATENT DOCUMENTS

| | | | | |
|---|---|---|---|---|
| 4,217,482 | A * | 8/1980 | Wadia | A47J 27/62 219/435 |
| 5,534,678 | A * | 7/1996 | Bowles | F24C 14/02 219/396 |
| 8,049,142 | B2 | 11/2011 | Blackson et al. | |
| 9,119,231 | B2 | 8/2015 | Johnson et al. | |
| 2008/0237212 | A1* | 10/2008 | Blackson | F24C 7/087 219/398 |
| 2014/0151362 | A1* | 6/2014 | Johnson | H05B 1/0263 219/497 |

FOREIGN PATENT DOCUMENTS

KR 2007033861 A 3/2007

* cited by examiner

*Primary Examiner* — Brian W Jennison
(74) *Attorney, Agent, or Firm* — Dority & Manning, P.A.

(57) ABSTRACT

A system and method for preheating a cooking chamber of an oven appliance. The oven appliance may include a bake heating element, a broil heating element, and a convection heating assembly including a convection heating element and a fan. The heating elements are operated simultaneously and/or in different combinations in order to rapidly preheat the cooking chamber. For example, the preheat cycle may include alternating between a first heating routine for a first time period and a second heating routine for a second time period. Preheating the cooking chamber in this manner will reduce oven preheat time, ensure proper heat balance, and improve overall cooking performance.

18 Claims, 6 Drawing Sheets

REDUCING PREHEAT TIME IN AN OVEN

FIELD OF THE INVENTION

The present disclosure relates generally to an oven appliance, or more specifically, to an apparatus and method for reducing the preheat time in an oven appliance.

BACKGROUND OF THE INVENTION

Convection oven appliances generally include a cabinet that defines a cooking chamber for receipt of food items for cooking. Heating elements are positioned within the cooking chamber to provide heat to food items located therein. The heating elements can include a bake heating element positioned at a bottom of the cooking chamber and/or a broil heating element positioned at a top of the cooking chamber. Convection oven appliances also include a convection heating assembly, which may include a convection heating element and fan or other mechanism for creating a flow of heated air within the cooking chamber.

During operation of convection oven appliances, food items within the cooking chamber are heated through various heat transfer mechanisms. Such mechanisms include: (1) radiation from oven walls, an oven door, and/or any exposed heating elements in the cooking chamber; (2) various convection mechanisms; and (3) conduction from a surface supporting the food items, e.g., a rack. Radiant heat transfer can provide a significant portion of the heat transferred to food items within the cooking chamber when the oven appliance is at a steady-state operating temperature.

Generally, oven appliances are preheated prior to inserting food items into the appliance's cooking chamber. Such preheating can be necessary to heat the oven appliance's walls, doors, and other exposed surfaces and bring the oven appliance up to the steady-state operating temperature. Prior to such preheating, radiant heat transfer from such components can be insufficient or unsuitable to properly cook food items within the cooking chamber. In reaching the operating temperature, common oven preheat algorithms attempt to reduce the overall preheat time while maintaining proper heat balance—i.e., the ratio of heat delivered from different areas of the oven. Failure to maintain proper heat balance can necessitate the extension of the preheat time. For example, if the preheat cycle relies largely on the high-power broil heating element to preheat the cooking chamber, the top portion of the food items may cook more quickly than the bottom portion of the food items due to the heat imbalance relative to the lower portion of the cooking chamber.

To avoid such heat imbalance, a user generally waits for the cooking chamber to reach the operating temperature and the preheat time may need to be extended to reach proper heat balance before inserting food items into the cooking chamber. Placing food items within the chamber too early may cause them to cook improperly. However, waiting for the oven to reach steady-state can consume a significant amount of the user's time. For example, preheat cycles can take over ten minutes to complete. In addition, valuable energy is consumed during preheating cycles that could be used to cook food items.

Accordingly, an apparatus or method for decreasing the preheat time of an oven appliance would be useful. More particularly, a preheating algorithm that reduces preheat time while maintaining proper heat balance within the cooking chamber would be especially beneficial.

BRIEF DESCRIPTION OF THE INVENTION

The present subject matter provides a system and method for preheating a cooking chamber of an oven appliance. The oven appliance may include a bake heating element, a broil heating element, and a convection heating assembly including a convection heating element and a fan. The heating elements are operated simultaneously and/or in different combinations in order to rapidly preheat the cooking chamber. For example, the preheat cycle may include alternating between a first heating routine for a first time period and a second heating routine for a second time period. Preheating the cooking chamber in this manner will reduce oven preheat time, ensure proper heat balance, and improve overall cooking performance. Additional aspects and advantages of the invention will be set forth in part in the following description, may be apparent from the description, or may be learned through practice of the invention.

In one exemplary embodiment, a method for preheating an oven appliance is provided. The oven appliance defines a cooking chamber for receiving food items for cooking, a bake heating element positioned at a bottom of the cooking chamber, a broil heating element positioned at a top of the cooking chamber, and a convection heating assembly including a convection heating element positioned at a rear of the cooking chamber. The method includes initiating a preheat cycle of the oven appliance to raise a temperature of the cooking chamber from a first temperature to a second temperature by alternating between a first heating routine for a first time period and a second heating routine for a second time period. The method further includes operating the bake heating element at a first voltage, the convection heating element at a second voltage, and the broil heating element at a third voltage during the first heating routine; and operating the convection heating element at a fourth voltage and the broil heating element at a fifth voltage during the second heating routine.

In another exemplary embodiment, an oven appliance is provided. The oven appliance includes a cooking chamber for receiving food items for cooking; a bake heating element positioned at a bottom of the cooking chamber; a broil heating element positioned at a top of the cooking chamber; and a convection heating assembly positioned at a rear of the cooking chamber and including a convection heating element. A controller is configured to preheat the oven appliance by alternating between a first heater routine for a first time period and a second heater routine for a second time period. In the first heater routine, the bake heating element is operating at a first voltage, the convection heating element is operating at a second voltage, and the broil heating element is operating at a third voltage. In the second heater routine, the bake heating element is off, the convection heating element is operating at a fourth voltage, and the broil heating element is operating at a fifth voltage.

In still another exemplary embodiment, a heating system for a cooking chamber of an oven appliance is provided. The heating system includes a first power source, a second power source, and a neutral line. A convection heating assembly includes a convection heating element connectable to the first power source through a convection relay and the second power source through a first safety relay. A bake heating element is connectable to the first power source through a circuit switching relay and a bake relay, and to the second power source through a second safety relay. A broil heating element is connectable to the second power source through the second safety relay, and to either the first power source through the circuit switching relay and a broil relay or to the neutral line through the broil relay. A controller is configured to preheat the oven appliance by selectively switching the convection relay, the first safety relay, the circuit switching relay, the bake relay, the broil relay, and the second safety relay between first and second states.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
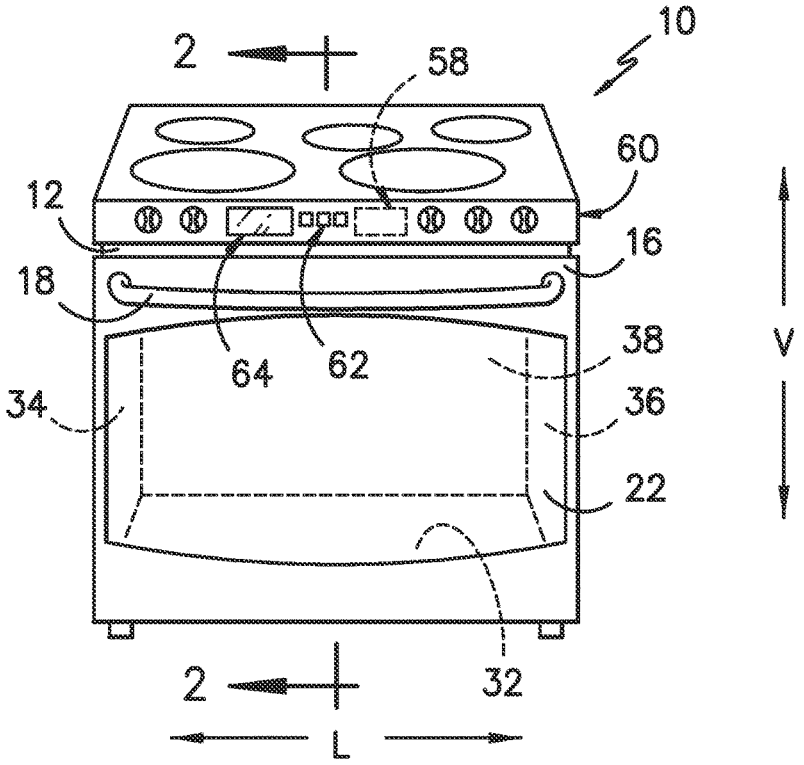
FIG. 1 provides a perspective view of an oven appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
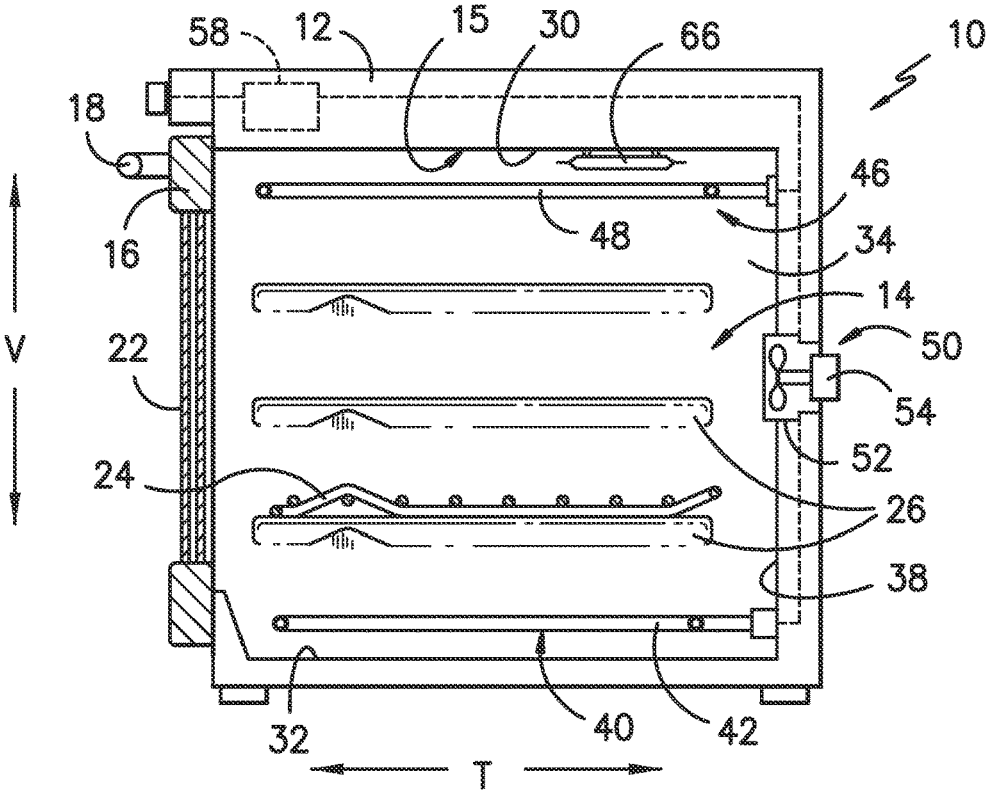
FIG. 2 provides a sectional view of the oven appliance of FIG. 1 taken along the line 2-2 of FIG. 1.

FIGS. 1 and 2 depict an exemplary oven appliance 10 that may be configured in accordance with aspects of the present disclosure. FIG. 1 provides a perspective view of oven appliance 10 according to an exemplary embodiment of the present subject matter. FIG. 2 provides a cross sectional view of oven appliance 10 taken along the 2-2 line of FIG. 1. For the particular embodiment of FIGS. 1 and 2, oven appliance 10 defines a vertical direction V, a lateral direction L and a transverse direction T. The vertical, lateral and transverse directions are mutually perpendicular and form an orthogonal direction system. As will be understood by those skilled in the art, oven appliance 10 is provided by way of example only, and the present subject matter may be used in any suitable appliance. Thus, the present subject matter may be used with other cooking appliances having different configurations, or even other types of appliances, e.g., washing machines, dishwashers, microwave ovens, etc.

Oven appliance 10 includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access cooking chamber 14. For example, a user can pull on handle 18 to open or close door 16 and access cooking chamber 14.

Oven appliance 10 can include a seal (not shown) between door 16 and cabinet 12 that assists with maintaining heat and cooking fumes within cooking chamber 14 when door 16 is closed as shown in FIG. 2. Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs 26 or sliding rails such that rack 24 may be conveniently moved into and out of cooking chamber 14 when door 16 is open.

As shown, various sidewalls define the cooking chamber 14. For example, cooking chamber 14 includes a top wall 30 and a bottom wall 32 which are spaced apart along the vertical direction V. Left sidewall 34 and right sidewall 36 (as defined according to the view as shown in FIG. 1) extend between the top wall 30 and bottom wall 32, and are spaced apart along the lateral direction L. A rear wall 38 may additionally extend between the top wall 30 and bottom wall 32 as well as between the left sidewall 34 and right sidewall 36, and is spaced apart from the door 16 along the transverse direction T. Cooking chamber 14 is thus defined between the top wall 30, bottom wall 32, left sidewall 34, right sidewall 36, and rear wall 38.

A lower heating assembly, e.g., bake heating assembly 40, may be included in oven appliance 10, and may include one or more heating elements, e.g. bake heating elements 42. Bake heating elements 42 may be disposed within the cooking chamber 14, such as adjacent bottom wall 32. In exemplary embodiments as illustrated, the bake heating elements 42 are electric heating elements, as is generally understood. Alternatively, the bake heating elements 42 may be gas burners or other suitable heating elements having other suitable heating sources. Bake heating elements 42 may generally be used to heat cooking chamber 14 for both cooking and cleaning of oven appliance 10.

Additionally, an upper heating assembly, e.g., broil heating assembly 46, may be included in oven appliance 10, and may include one or more upper heating elements, e.g., broil heating elements 48. Broil heating elements 48 may be disposed within the cooking chamber 14, such as adjacent top wall 30. In exemplary embodiments as illustrated, the broil heating elements 48 are electric heating elements, as is generally understood. Alternatively, the broil heating elements 48 may be gas burners or other suitable heating elements having other suitable heating sources. Broil heating elements 48 may additionally generally be used to heat cooking chamber 14 for both cooking and cleaning of oven appliance 10.

Oven appliance 10 may also include a convection heating assembly 50. Convection heating assembly 50 may have a fan 52 and a convection heating element 54. Convection heating assembly 50 is configured for selectively urging a flow of heated air into cooking chamber 14. For example, fan 52 can pull air from cooking chamber 14 into convection heating assembly 50 and convection heating element 54 can heat such air. Subsequently, fan 52 can urge such heated air back into cooking chamber 14. As another example, fan 52 can cycle heated air from cooking chamber 14 within cooking chamber 14 in order to generate forced convective air currents without use of convection heating element 54. Like heating elements 42, 48 discussed above, convection heating element 54 may be, e.g., a gas, electric, or microwave heating element or any suitable combination thereof. According to an alternative exemplary embodiment, convection heating assembly 50 need not include fan 52.

Oven appliance 10 is further equipped with a controller 58 to regulate operation of the oven appliance 10. For example, controller 58 may regulate the operation of oven appliance 10 including heating elements 42, 48, 54 (and heating assemblies 40, 46, 50 generally). Controller 58 may be in communication (via for example a suitable wired or wireless connection) with the heating elements 42, 48, 54 and other suitable components of the oven appliance 10, as discussed herein. In general, controller 58 may be operable to configure the oven appliance 10 (and various components thereof) for cooking. Such configuration may be based on a plurality of cooking factors of a selected operating cycle, as discussed herein.

By way of example, controller 58 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 58 may be positioned in a variety of locations throughout oven appliance 10. In the illustrated embodiment, controller 58 may be located within a user interface panel 60 of oven appliance 10 as shown in FIGS. 1 and 2. In such an embodiment, input/output ("I/O") signals may be routed between the control system and various operational components of oven appliance 10 along wiring harnesses that may be routed through cabinet 12. Typically, controller 58 is in communication with user interface panel 60 and controls 62 through which a user may select various operational features and modes and monitor progress of oven appliance 10. In one embodiment, user interface 60 may represent a general purpose I/O ("GPIO") device or functional block. In one embodiment, user interface 60 may include input components, such as one or more of a variety of electrical, mechanical or electro-mechanical input devices including rotary dials, push buttons, and touch pads. User interface 60 may include a display component, such as a digital or analog display device 64 designed to provide operational feedback to a user.

User interface 60 may be in communication with controller 58 via one or more signal lines or shared communication busses. Controller 58 may also be communication with one or more sensors, e.g., a temperature sensor 66 that is used to measure temperature inside cooking chamber 14 and provide such measurements to controller 58. Temperature sensor 66 is shown (in FIG. 2) in the top and rear of cooking chamber 14. However, other locations may be used and, if desired, multiple temperature sensors may be applied as well. In this manner, controller 58 may operate heating elements 42, 48, 54 in response to user manipulation of user interface panel 60. Controller 58 can also receive temperature measurements from temperature sensor 66 placed within cooking chamber 14 and e.g., provide a temperature indication to the user with display 64.

It should be appreciated that the invention is not limited to any particular style, model, or configuration of oven appliance 10. The exemplary embodiment depicted in FIGS. 1 and 2 is for illustrative purposes only. For example, different locations may be provided for user interface 60, different configurations may be provided for rack 24 or ribs 26, and other differences may be applied as well. In addition, the oven appliance 10 may be a wall oven, an oven/range combo, a microwave oven, an electric oven, a gas oven, etc.

Figure 3:
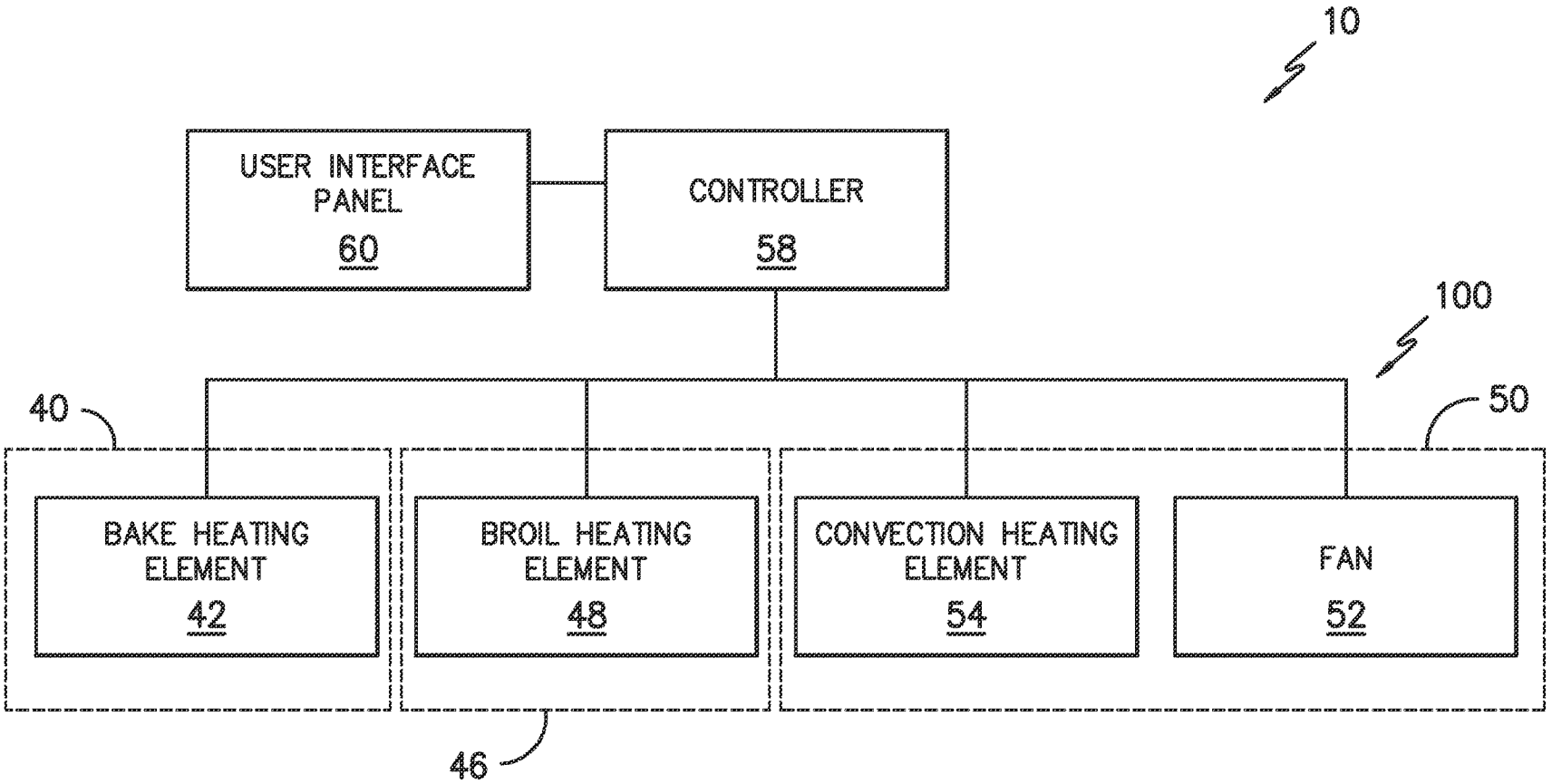
FIG. 3 is a schematic diagram of an oven appliance according to an exemplary embodiment of the present subject matter.

Referring now to FIG. 3, a schematic view of oven appliance 10 is illustrated. As illustrated, controller 58 may be operatively coupled to or in communication with user interface panel 60, a heating system 100 including heating assemblies 40, 46, 50, and other components of oven appliance 10. More particularly, controller 58 is operatively coupled to or in communication with bake heating element 42, broil heating element 48, fan 52, and/or convection heating element 54, and may operate these elements, e.g., in response to user manipulation of user interface panel 60. The preheat operation of oven appliance 10 is regulated by controller 58 in a manner described in greater detail below. More particularly, aspects of the present disclosure are directed to heating system 100 configurations and operation that may reduce the amount of time it take for oven appliance 10 to preheat to its steady-state operating temperature.

Figure 4:
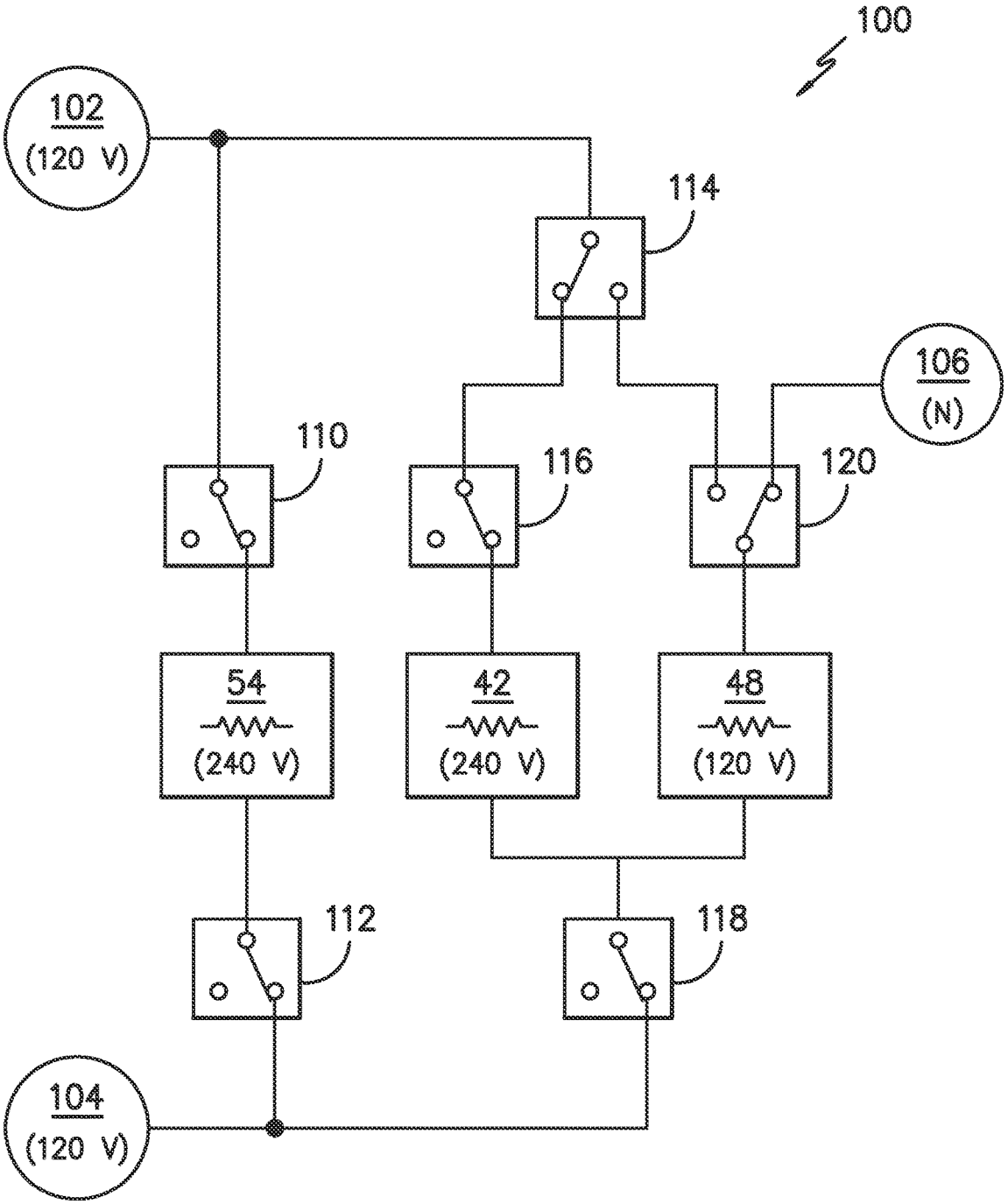
FIG. 4 is a schematic power supply diagram of the oven appliance of FIG. 1 configured to operate a first heating routine according to an exemplary embodiment of the present subject matter.
Figure 5:
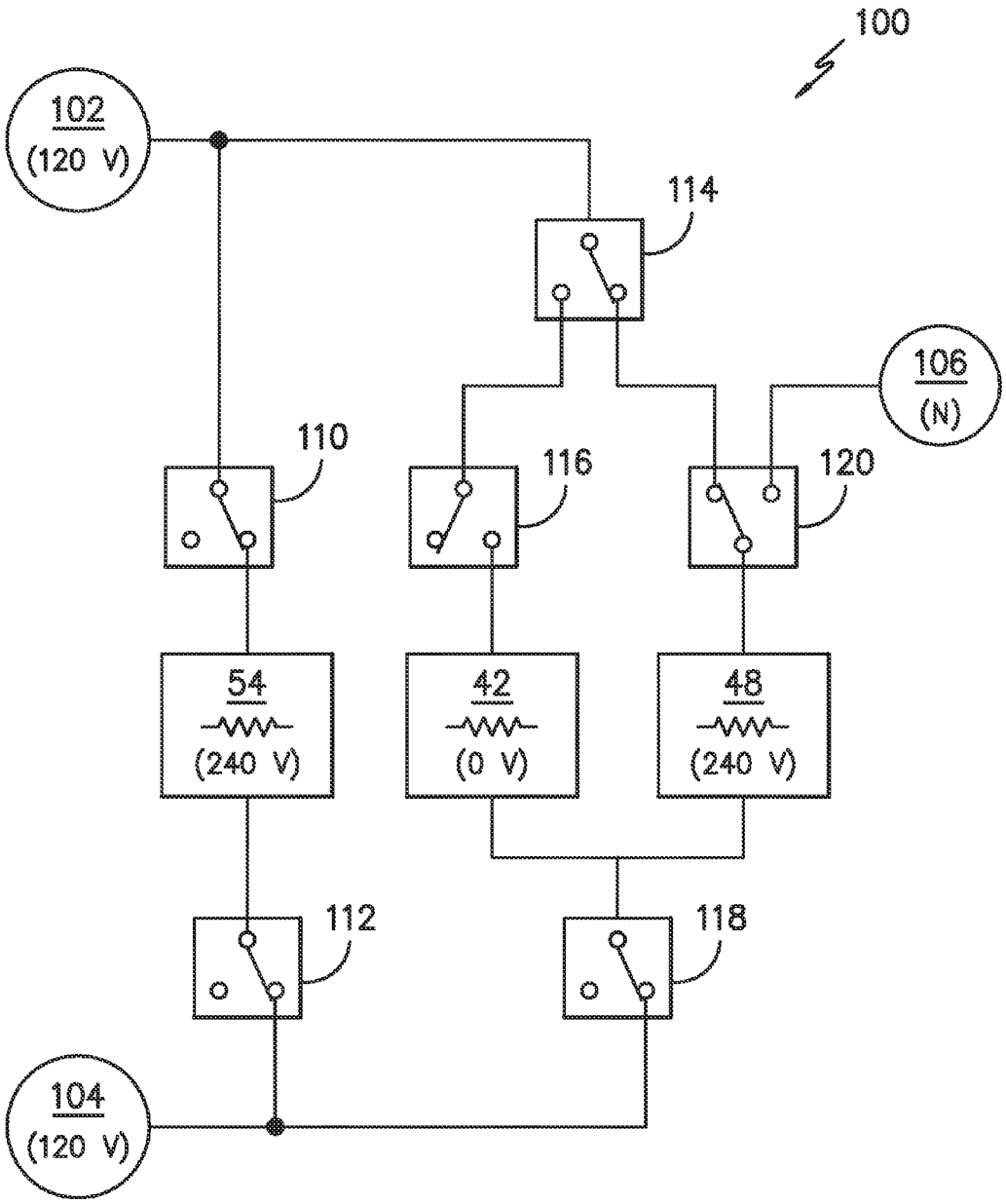
FIG. 5 is a schematic power supply diagram of the oven appliance of FIG. 1 configured to operate a second heating routine according to an exemplary embodiment of the present subject matter.

Although there are a variety of heating system 100 configurations that may achieve the desired preheating operation discussed below, one such configuration is discussed in detail in reference to FIGS. 4 and 5. In general, FIGS. 4 and 5 illustrate a series of power sources, wiring harnesses, and relays for energizing bake heating element 42, broil heating element 48, and convection heating element 54. One skilled in the art will appreciate that the schematic diagrams shown in FIGS. 4 and 5 are a simplified representation of the electrical connections and components that may be used to preheat oven appliance 10. Other components may be used, other configurations are possible, and these variations may be within the scope of the present subject matter.

Oven appliance 10 may be powered by mains electricity, e.g., at 240V. However, because not all components of oven appliance 10 may operate at 240V, voltage regulation may be achieved using any suitable voltage-adjusting device. For example, a triode for alternating current ("TRIAC") may be used to reduce the mains electricity, e.g., 240V, to a lower voltage for powering some of the oven appliance 10 components. By dividing the power in this manner, the total voltage supplied to each of bake heating element 42, broil heating element 48, and convection heating element 54 can be adjusted by selectively coupling each element to power sources having different voltages.

As shown, heating system 100 includes a first power source 102, a second power source 104, and a neutral line 106. According to the illustrated embodiment, a TRIAC (not shown) may be used to split the 240V input voltage, such that first power source 102 and second power source 104 each provide 120V. As will be described in more detail below, this power configuration may enable versatile power supply configurations to heating system 100. For example, convection fan 52 may be operated at 120V and convection heating element 54 may be operated at 240V. Although the system described herein uses 120V and 240V, one skilled in the art will appreciate that these voltages are only exemplary, and may be higher or lower depending on the needs of the application. Indeed, any number of power sources providing power at any voltage may be achieved by using suitable electronics. The present subject matter is not limited to a system that operates at either 120V or 240V.

Notably, if a heating element is connected across both first power source 102 and second power source 104, that element may be powered at 240V (i.e., 120V+120V). By contrast, if that element is connected across either first power source 102 or second power source 104 and across neutral line 106, that element may be powered at 120V. Therefore, by selectively adjusting the electrical connections between various heating elements and power sources, different heating element voltages may be achieved. By energizing different heating elements at different voltages for different time periods, heating system 100 may operate according to heating routines that optimize heating efficiency, decrease the total preheat time of oven appliance 10, and ensure proper heat balance throughout cooking chamber 14.

Convection heating element 54 is connectable to first power source 102 through a convection relay 110 and to second power source 104 through a first safety relay 112. According to the illustrated embodiment, first safety relay 112 is a double line break relay, but may be any relay or other electronic component sufficient to connect and/or disconnect convection heating element 54 from second power source 104. Notably, convection heating element 54 is only energized when both convection relay 110 and first safety relay 112 are in the CLOSED state. If either convection relay 110 or first safety relay 112 is in the OPEN state, convection heating element 54 is not energized. Notably, this configuration also results in convection heating element 54 being operable at only one voltage—240V. According to the exemplary embodiment, convection fan 52 (not illustrated in FIGS. 4 and 5) also operates at only one voltage—120V. However, one skilled in the art will appreciate that either element may be operated at another voltage if desired.

Bake heating element 42 is connectable to first power source 102 through a circuit switching relay 114 and a bake relay 116, and to second power source 104 through a second safety relay 118. In addition, broil heating element 48 is connectable to second power source 104 through second safety relay 118, and to either first power source 102 through circuit switching relay 114 and a broil relay 120 or to neutral line 106 through broil relay 120. In this manner, circuit switching relay 114 is configured to shunt power off of bake heating element 42 when full power broil (e.g., 240V) is desired from broil heating element 48. Notably, even if circuit switching relay 114 is energizing bake heating element 42, broil relay 120 may connect broil heating element 48 to neutral line 106, thus completing a circuit that powers broil heating element 48 at half power broil (e.g., 120V).

Safety relays 112, 118 are intended to ensure that heating elements 42, 48, 54 are only energized when intended. For example, regarding convection heating element 54, controller 58 must close both convection relay 110 and first safety relay 112 in order to energize convection heating element 54. In this manner, if a software glitch or wiring malfunction causes convection relay 110 to be inadvertently energized (i.e., closed), first safety relay 112 may prevent convection heating element 54 from being energized by acting as an open circuit. Second safety relay 118 operates in the same manner, except that it is shared by both bake heating element 42 and broil heating element 48. Two safety relays 112, 118 are shown in the illustrated configuration to ensure that the current limits of a single relay are not exceeded. Bake heating element 42 and broil heating element 42 may share second safety relay 118 because, as described above, they are never operated simultaneously at full power (e.g., 240V), and thus remain within the hardware limitations of the relay. If all heating elements 42, 48, 54 were powered through a single safety relay, the maximum current capacity of the safety relay may be exceeded, resulting in component failure and potentially faulty operation of oven appliance 10.

Although the illustrated embodiment shows two safety relays, one or more than two safety relays may be used instead. For example, a single safety relay having a higher current capacity may be used, or each heating element 42, 48, 54 may have a dedicated safety relay. Alternatively, the safety relays may be eliminated altogether. One skilled in the art will appreciate that the configuration described above is exemplary and is not intended to limit the scope of the present subject matter.

Figure 6:
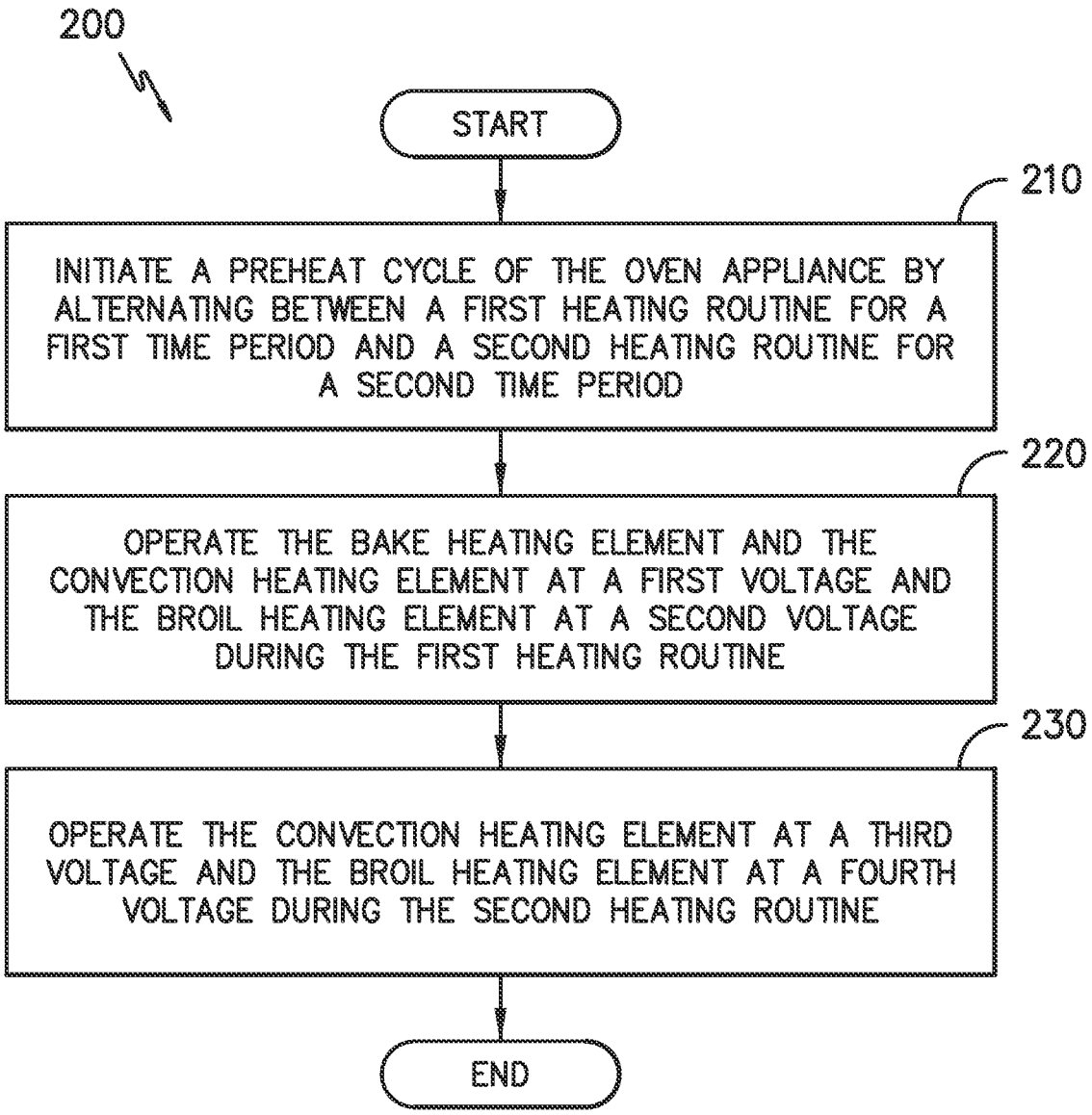
FIG. 6 illustrates a method for operating an oven appliance according to an exemplary embodiment of the present disclosure.

According to the illustrated embodiments of FIG. 4 through 6, wiring harnesses and relays are provided to connect the various components of heating system 100 such that a variety of heating routines may be achieved by selectively switching relays between first and second states. More particularly, controller 58 may be configured to preheat oven appliance 10 by selectively switching convection relay 110, circuit switching relay 114, bake relay 116, and broil relay 120 between first and second states to control voltages throughout heating system 100. In addition, first safety relay 112 and second safety relay 118 may be used to ensure that inadvertent energizing of the heating elements is avoided.

For example, if heating system 100 is configured as shown in FIG. 4, convection heating element 54 is connected to first power source 102 through convection relay 110 and to second power source 104 through first safety relay 112, and is thus operating at 240V. Bake heating element 42 is connected to first power source 102 through circuit switching relay 114 and bake relay 116 and to second power source 104 through second safety relay 118, and is thus operating at 240V. Broil heating element 46 is connected to second power source 104 through second safety relay 118 and to neutral line 106 through broil relay 120, and is thus operating at 120V.

A second exemplary heating system 100 configuration is shown in FIG. 5. According to this configuration, convection heating element 54 is connected to both first power source 102 and second power source 104 as described above, and is thus operating at 240V. Bake heating element 42 is disconnected (i.e., 0V) because bake relay 116 is in the OPEN state. Broil heating element 48 is connected to first power source 102 through circuit switching relay 114 and broil relay 120, and to second power source 104 through second safety relay 118, and is thus operating at 240V.

Now that the details of heating system 100 according to an exemplary embodiment of the present subject matter have been presented, an exemplary method 200 of preheating oven appliance 10 will be described. FIG. 6 illustrates method 200 for operating an appliance, such as oven appliance 10, according to exemplary embodiments of the present subject matter. It should be understood that method 200 may be used in other oven appliances as well, such as range appliances. Controller 58 may be programmed to perform method 200, e.g., by selectively energizing heating elements 42, 48, 54 according to one or more heating routines.

Method 200 is a method for preheating an appliance, e.g., oven appliance 10. In particular, method 200 facilitates reducing the preheat time of oven appliance 10. During the preheat cycle of oven appliance 10, a temperature within cooking chamber 14 is raised from a first temperature, e.g., an ambient temperature of about seventy degrees Fahrenheit, to a second temperature, e.g., a steady-state operating temperature of about three hundred and fifty degrees Fahrenheit. Method 200 can reduce the amount of time necessary to reach this steady-state operating temperature while maintaining a proper heat balance among the various surfaces of cooking chamber 14.

Method 200 includes, at step 210, initiating a preheat cycle of the oven appliance 10 to raise a temperature of the cooking chamber 14 from a first temperature to a second temperature by alternating between a first heating routine 250 for a first time period and a second heating routine 260 for a second time period. Notably, first heating routine 250 may be achieved by configuring heating system 100 as shown in FIG. 4 and second heating routine 260 may be achieved by configuring heating system 100 as shown in FIG. 5. During the preheat cycle, cooking chamber 14 changes from a first, lower temperature to a second, higher temperature as the cooking chamber 14 is heated to the steady-state operating temperature.

At step 220, the controller operates bake heating element 42 and convection heating element 54 at a first voltage and broil heating element 48 at a second voltage during first heating routine 250. At step 230, controller 58 operates convection heating element 54 at a third voltage and broil heating element 48 at a fourth voltage during second heating routine 260.

Figure 7:
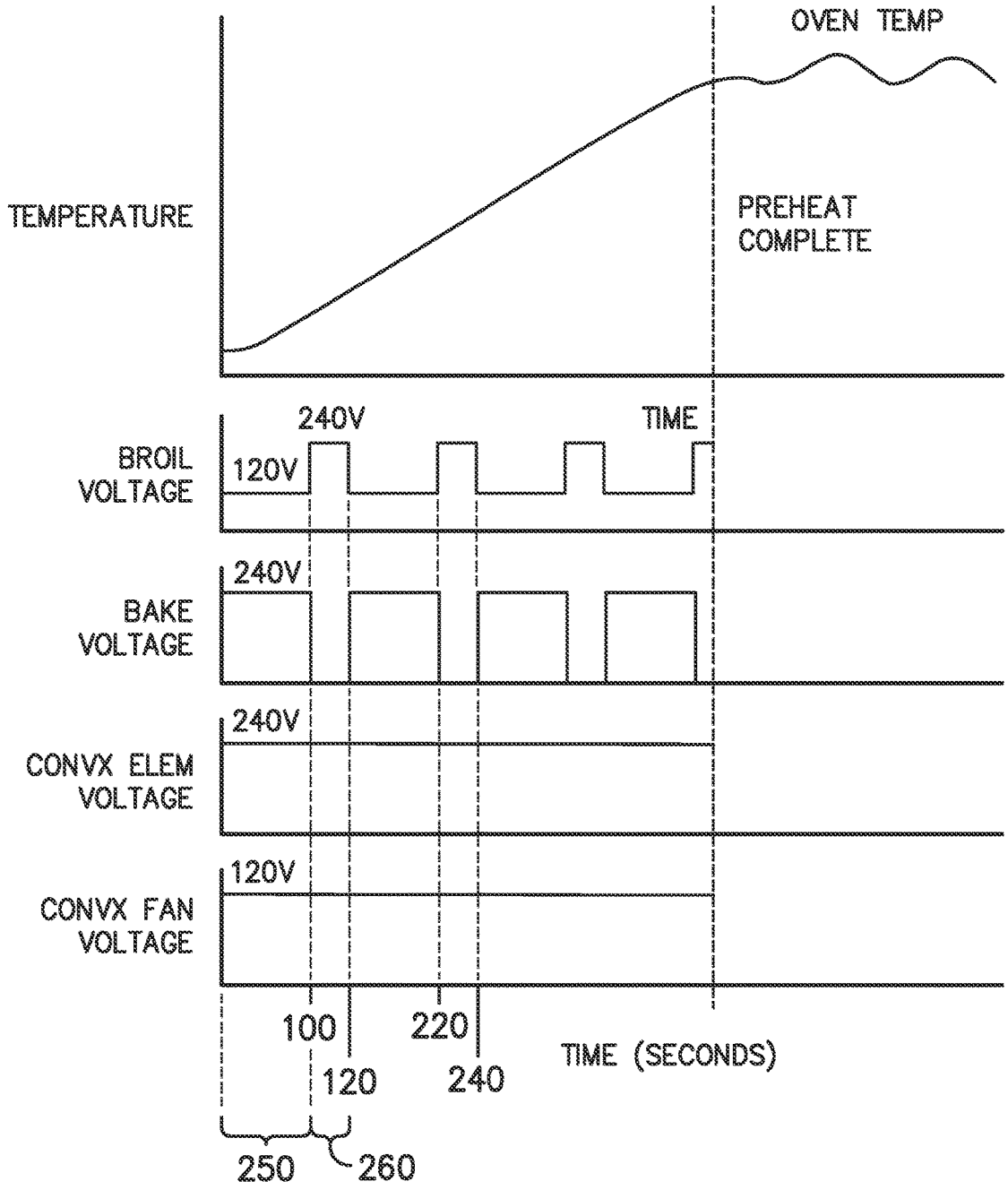
FIG. 7 illustrates a plot of the power supplied to each heating element as well as the resulting temperature of the cooking chamber as the controller alternates between heating routines during a preheat cycle.

For example, according to an exemplary embodiment, the first voltage, the third voltage, and the fourth voltage may each be approximately 240V, and the second voltage may approximately 120V. In addition, the first time period may be 100 seconds and the second time period may be 20 seconds. Operation of heating system 100 according to this exemplary embodiment is illustrated in FIG. 7, which provides a plot of the operating voltages of bake heating element 42, broil heating element 48, convection heating element 54, and convection fan 52 according to these exemplary voltages. In addition, FIG. 7 provides a plot of the oven appliance 10 temperatures over the same preheat cycle.

As shown, after the preheat cycle is initiated, broil heating element is operated at 120V and bake heating element is operated at 240V for the duration of first heating routine 250—i.e., 100 seconds. During second heating routine 260, broil heating element is operated at 240V and bake heating element is not energized for 20 seconds. Notably, convection heating element 54 and the convection fan 52 are operated continuously throughout the entire preheat cycle at 240V and 120V, respectively. Controller 58 is configured to alternate the power supply to heating system 100 between first heating routine 250 and second heating routine 260 until the operating temperature is reached and preheat is complete. By operating bake heating element 42 and broil heating element 48 as shown, the preheat time of oven appliance 10 may be reduced and heat balance within cooking chamber 14 may be maintained.

Although the embodiment described in reference to FIG. 7 contemplates a single preheat stage during which cooking chamber 14 is preheated by alternating between first heating routine 250 for the first time period and second heating routine 260 for the second time period, multi-stage preheat cycles are contemplated and within the scope of the present invention. For example, the preheat cycle may include a second preheat stage during which cooking chamber 14 is preheated by alternating between a third heating routine for a third time period and a fourth heating routine for a fourth time period. According to an exemplary embodiment, the second preheat stage may begin after the temperature of cooking chamber 14 reaches a predetermined temperature. One skilled in the art will appreciate that two or more preheat stages may be incorporated into a preheat cycle, and the stages may be triggered by a simple lapse of a predetermined time, or by a specific trigger condition occurring within oven appliance 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A method for preheating an oven appliance, the oven appliance defining a cooking chamber for receiving food items for cooking, a bake heating element positioned at a bottom of the cooking chamber, a broil heating element positioned at a top of the cooking chamber, and a convection heating assembly comprising a convection heating element positioned at a rear of the cooking chamber, the method comprising:

initiating a preheat cycle of the oven appliance to raise a temperature of the cooking chamber from a first temperature to a second temperature by transitioning from a first preheat stage to a second preheat stage when the temperature of the cooking chamber reaches a predetermined temperature between the first temperature and the second temperature, wherein the first preheat stage comprises alternating between a first heating routine for a first time period and a second heating routine for a second time period;

operating the bake heating element at a non-zero first voltage, the convection heating element at a non-zero second voltage, and the broil heating element at a non-zero third voltage during the first heating routine; and operating the convection heating element at a non-zero fourth voltage and the broil heating element at a non-zero fifth voltage during the second heating routine.

2. The method of claim 1, wherein the first voltage, the second voltage, the fourth voltage, and the fifth voltage are each approximately 240V, and the third voltage is approximately 120V.

3. The method of claim 2, wherein the first time period is 100 seconds and the second time period is 20 seconds.

4. The method of claim 1, wherein the second preheat stage comprises preheating the cooking chamber by alternating between a third heating routine for a third time period and a fourth heating routine for a fourth time period.

5. The method of claim 1, wherein the convection heating assembly further comprises a fan, the fan being operated at 120V during the first time period and the second time period.

6. The method of claim 1, wherein at least one of the first voltage, the second voltage, the third voltage, the fourth voltage, and the fifth voltage is less than 240V, but greater than 120V.

7. An oven appliance, comprising:

a cooking chamber for receiving food items for cooking;

a bake heating element positioned at a bottom of the cooking chamber;

a broil heating element positioned at a top of the cooking chamber;

a convection heating assembly positioned at a rear of the cooking chamber and comprising a convection heating element; and a controller means for preheating the oven appliance by regulating a heating system operably coupled to the bake heating element, the broil heating element, and the convection heating assembly, the heating system transitioning from a first preheat stage to a second preheat stage when a temperature of the cooking chamber reaches a predetermined temperature, wherein the first preheat stage comprises alternating between a first heater routine for a first time period and a second heater routine for a second time period, wherein in the first heater routine, the bake heating element is operating at a non-zero first voltage, the convection heating element is operating at a non-zero second voltage, and the broil heating element is operating at a non-zero third voltage, and in the second heater routine, the bake heating element is off, the convection heating element is operating at a non-zero fourth voltage, and the broil heating element is operating at a non-zero fifth voltage.

8. The oven appliance of claim 7, wherein the first voltage, the second voltage, the fourth voltage, and the fifth voltage are each 240V, and the third voltage is 120V.

9. The oven appliance of claim 8, wherein the first time period is 100 seconds and the second time period is 20 seconds.

10. The oven appliance of claim 7, wherein in the second preheat stage, the controller means is configured to regulate the heating system to preheat the cooking chamber by alternating between a third heater routine for a third time period and a fourth heater routine for a fourth time period.

11. The oven appliance of claim 7, wherein the convection heating assembly further comprises a fan, the fan being operated at 120V during the first time period and the second time period.

12. The oven appliance of claim 7, wherein at least one of the first voltage, the second voltage, the third voltage, the fourth voltage, and the fifth voltage is less than 240V, but greater than 120V.

13. A heating system for a cooking chamber of an oven appliance, the heating system comprising:

a first power source, a second power source, and a neutral line;

a convection heating assembly comprising a convection heating element connectable to the first power source through a convection relay and the second power source through a first safety relay;

a bake heating element connectable to the first power source through a circuit switching relay and a bake relay, and to the second power source through a second safety relay;

a broil heating element connectable to the second power source through the second safety relay, and to either the first power source through the circuit switching relay and a broil relay or to the neutral line through the broil relay; and a controller means operably coupled to the convection relay, the first safety relay, the circuit switching relay, the bake relay, the broil relay, and the second safety relay, the controller means being configured to preheat the oven appliance by selectively switching the convection relay, the first safety relay, the circuit switching relay, the bake relay, the broil relay, and the second safety relay between first and second states based at least in part by transitioning from a first preheat stage to a second preheat stage when the temperature of the cooking chamber reaches a predetermined temperature.

14. The heating system of claim 13, wherein the controller means preheats the cooking chamber by alternating between a first heater routine for a first time period and a second heater routine for a second time period, wherein in the first heater routine, the bake heating element is operating at a non-zero first voltage, the convection heating element is operating at a non-zero second voltage, and the broil heating element is operating at a non-zero third voltage, and in the second heater routine, the bake heating element is off, the convection heating element is operating at a non-zero fourth voltage, and the broil heating element is operating at a non-zero fifth voltage.

15. The heating system of claim 14, wherein the first voltage, the second voltage, the fourth voltage, and the fifth voltage are each 240V, and the third voltage is 120V.

16. The heating system of claim 15, wherein the first time period is 100 seconds and the second time period is 20 seconds.

17. The heating system of claim 14, wherein the second preheat stage comprises alternating between a third heater routine for a third time period and a fourth heater routine for a fourth time period during a second preheat stage.

18. The heating system of claim 14, wherein the convection heating assembly further comprises a fan, the fan being operated at 120V during the first time period and the second time period.

* * * * *